United States Patent [19]

Uchida

[11] 4,034,838

[45] July 12, 1977

[54] APPARATUS FOR HANDLING PAPERS AND TISSUES

[75] Inventor: Isamu Uchida, Chigasaki, Japan

[73] Assignee: Laurel Bank Machine Co., Ltd., Tokyo, Japan

[21] Appl. No.: 648,745

[22] Filed: Jan. 12, 1976

[30] Foreign Application Priority Data

Jan. 14, 1975 Japan ..... 50-7220

[51] Int. Cl.[2] ..... G07F 1/06

[52] U.S. Cl. ..... 194/4 R; 209/DIG. 2

[58] Field of Search ..... 209/DIG. 2; 194/DIG. 22, 4

[56] References Cited

U.S. PATENT DOCUMENTS

| | | | |
|---|---|---|---|
| 3,108,680 | 10/1963 | Ellis et al. | 209/DIG. 2 |
| 3,433,344 | 3/1969 | Peterson | 194/DIG. 22 |

*Primary Examiner*—Allen N. Knowles

[57] ABSTRACT

A device is provided for examining paper money or the like while it is being transported by a delivery device. Comprising a storage device for storing therein paper money discriminated by a discriminating device. A temporary reservoir isdisposed between the discriminating device and the paper money storage device and includes a transparent glass sheet. The paper money which has been judged as being proper by the discriminating device is temporarily stopped in the reservoir so that the paper money can be seen from the outside through the transparent glass sheet of the reservoir.

8 Claims, 1 Drawing Figure

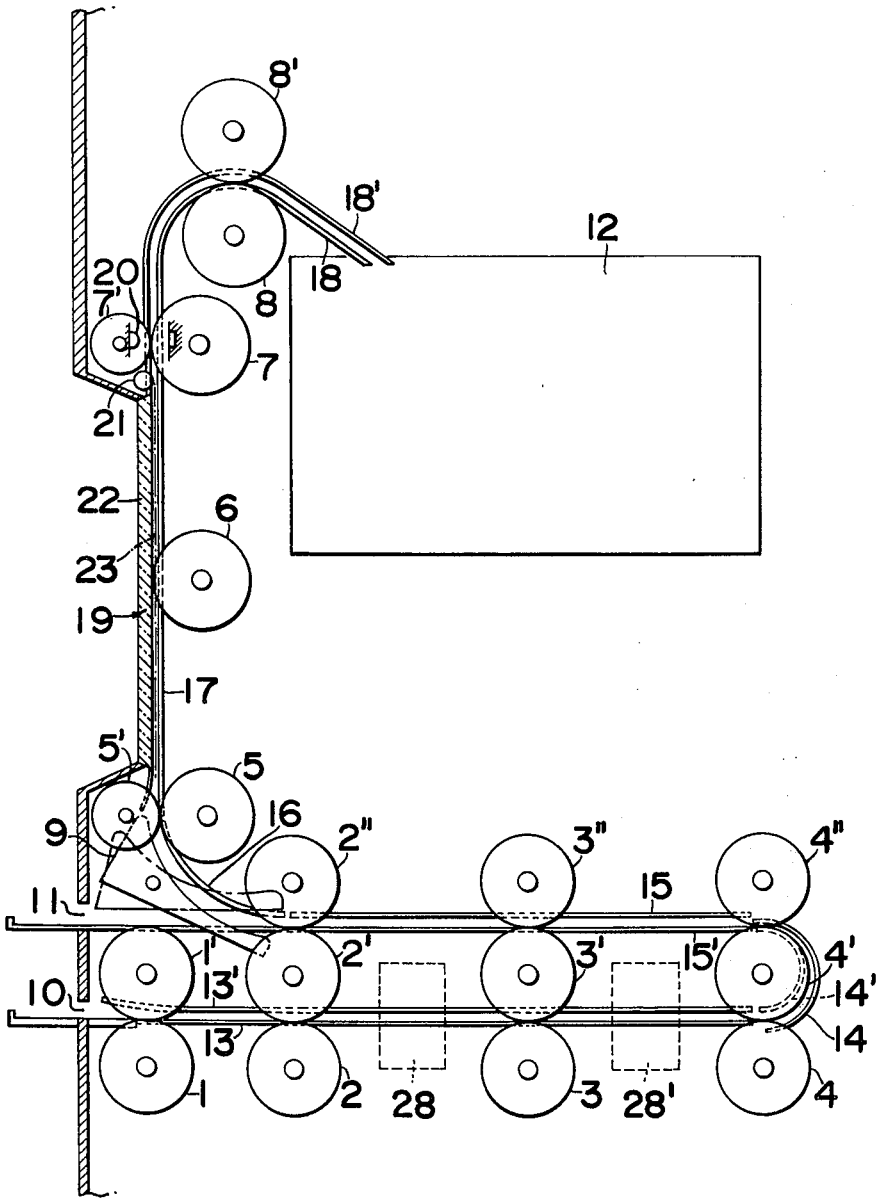
8'
18'
12
20
7'
8
18
7
21
22
6
23
19
17
5'
5
9
16
2"
3"
4"
11
15
1'
2'
3'
15'
4'
10
13'
14'
13
14
1
2
28
3
28'
4

APPARATUS FOR HANDLING PAPERS AND TISSUES

This invention relates to an apparatus for handling sheets of paper. More particularly, the invention relates to an apparatus for the automatic handling of paper moneys, such as an automatic money depositing machine or an automatic money changer. According to the apparatus of this invention, paper money or the like is inserted in an insertion inlet, and it is examined in a discriminating zone, and counterfeit paper money is immediately delivered to a return oultet while paper money which has been judged as being good is temporarily stopped in a temporary reservoir disposed so that the paper money can be seen easily and clearly from the outside and after completion of such operation as money changing, the paper money temporarily stopped in the reservoir is fed to a storage box.

Recently, persons well acquainted with the mechanism of a counterfeit money-detecting device prepare counterfeit or falsified paper money (hereinafter referred to as "wrong paper money") capable of passing through the detecting device. In the conventional system, once wrong paper money is inserted in an insertion inlet, other persons cannot know that the wrong paper money is now being exchanged. Accordingly, the use of wrong paper is often tried without fear.

According to this invention, paper money which has been judged good by the discriminating or detecting device is temporarily stopped in a temporary reservoir disposed so that it can be seen easily and clearly from the outside. Therefore, when wrong paper money is used, even if it has passed through the detecting zone, it is placed in this reservoir and is conspicuous to increase an chance of detection of the offense and to impart to the criminal a feeling of being seen by other persons to produce a sensation of fear. Accordingly,, the apparatus of this invention is very effective for preventing the misdeed of using wrong paper money.

Further, even if good paper money is used, there is sometimes apprehension on the part of the user since the money is no longer visible. According to this invention, since the inserted paper money is temporarily stopped in the temporary reservoir and rendered visible, this apprehension is effectively prevented.

This invention will now be described in detail by reference to the accompanying drawing the sole FIGURE of which illustrates one embodiment of the paper-handling apparatus of this invention, in which the front of the machine at which a user performs a money changing operation or the like is located on the left side.

In the embodiment shown in the drawing, when paper money is placed on an insertion inlet 10, the placement is detected by an optical detecting device (not shown) and a signal for initiating rotation of rollers is emitted to rotate the rollers. Thus, the inserted paper money is taken in by take-in rollers 1 and 1' and delivered to the right. The paper money taken in and delivered to the right by the rollers 1 and 1' is then transported to the right by rollers 2, 2', 3, 3', 4 and 4' while it is being guided by guides 13 and 13'. Then, the advance direction of the paper money separated from the rollers 4 and 4' is changed by 180° by paper money guides 14 and 14' and the paper money is fed to the left by rollers 4', 4'', 3', 3'', 2' and 2'' and guided by paper money guides 15 and 15'. While the paper money continues the above travel, namely during a period ranging from the point when the forward end of the paper money is between the rollers 2 and 2' to the point when the paper money arrives at the rollers 2' and 2'' through the rightward movement, 180° change of the advance direction and the leftward movement, discrimination of the paper money is performed by discriminating devices 28 and 28'. When the paper money is judged as being good by the discriminating devices 28 and 28', the paper money is allowed to pass between a guide plate 9 and a paper money guide 16 and is then introduced into a temporary reservoir 19. Then, the forward end of the paper money is guided upwardly by rollers 5, 5', 6, 7 and 7', and when the paper money arrives at an optical detecting device 20, arrival of the paper money is detected by this device 20 and a signal of stopping all for the rollers is emitted. Namely, the paper money is stopped and stored in the temporary reservoir 19 in the state that the forward end of the paper money is between the rollers 7 and 7' and the front or back face of the paper money 23 can be substantially seen through a transparent glass sheet 22. The distance between the rollers 5 and 5' and 7 and 7' is made a little longer than the length of the longest currency paper money now distributed. An illuminating lamp 21 is lighted as soon as the paper money is stopped in the temporary reservoir 19 so that the money can easily be observed from the outside.

When the paper money arrives at the temporary reservoir 19, the user can perform an intended operation such as money changing or automatic money deposition, and on completion of this operation, a signal is emitted automatically or by depressing a button to initiate rotation of rollers 7, 7', 8 and 8', whereby the paper money is fed to a prescribed storage device 12 through paper money guides 18 and 18'.

When the paper money is judged to be wrong by the discriminating zone or judgement by the discriminating device is impossible, it is treated as wrong paper money in the following manner.

When the inserted paper is judged as being wrong paper money, a signal is emitted to a solenoid (not shown) disposed between the discriminating zone and the guide plate 9 to rotate the guide plate 9 to an upper position indicated by dotted lines in the drawing, whereby the wrong paper money coming from the rollers 2 and 2' passes between the guide plate 9 and the paper money guide 15' and is returned to the outside from a return outlet 11. Discharge of the wrong paper money from the return outlet 11 is detected by an optical device (not shown) to emit a signal for returning the guide plate 9 to the normal position. Thus, the inserted paper money which has been judged as being wrong or the discrimination of which has been impossible is immediately discharged outside from the return outlet. On the other hand, the paper money which has been judged as being good is stopped and temporarily stored in the temporary reservoir prior to the actual money changing or automatic money deposition and therefore, it can be seen from the outside very easily and clearly. Accordingly, a criminal is not readily inclined to use wrong paper money and the apparatus of this invention is very effective for preventing the crime. Further, since it is possible for a user to confirm the inserted paper money after insertion, apprehension can be completely prevented.

In the above embodiment, the temporary reservoir is disposed in the vicinity of the front of the machine and a glass sheet is lined on the temporary reservoir so that the inserted paper can be observed easily from the outside. The intended objects of this invention can similarly be attained even when the temporary reservoir is disposed at another optional location and an image of an inserted paper money is transmitted from the reservoir so that the image is focussed at a suitable portion on the front of the machine where the image can be seen easily from the outside. This modification or the like may be made optionally according to need.

What is claimed is:

1. An apparatus for handling papers and tissues comprising a delivery device for transporting paper money or the like, a device for discriminating the paper money or the like while it is being transported by the delivery device, a storage device for storing therein paper money discriminated by the discriminating device, means for delivering wrong paper money to a return outlet after passage through the discriminating device, means for/temporarily halting paper money which has been judged as being good by the discriminating device in a temporary reservoir disposed so that the paper money can be seen from the outside and means for feeding the paper money which has been temporarily stopped in the temporary reservoir for storage in the storage device controlled by signals indicating completion of prescribed operations such as money changing, receipt and disbursement.

2. Apparatus as claimed in claim 1 comprising means for diverting money from said delivery device externally of the apparatus for retrieval upon detection of improper money in said reservoir.

3. Apparatus as claimed in claim 2 comprising viewing means for viewing the money in said reservoir.

4. Apparatus as claimed in claim 3 wherein said viewing means comprises a fixed transparent plate and illumination means for illuminating the money in said reservoir.

5. Apparatus as claimed in claim 3 comprising an inlet for the money and an outlet adjacent the inlet for diverted money, said viewing means being disposed adjacent said inlet and outlet.

6. Apparatus as claimed in claim 5 wherein said delivery device has guide paths for feeding the money from said inlet to said viewing means.

7. Apparatus as claimed in claim 6 wherein said guide paths include a 180° reversal of travel of the money.

8. Apparatus as claimed in claim 6 wherein the money diverting means is disposed between said guide paths and said viewing means.

* * * * *